US012366026B2

(12) United States Patent
Hwang et al.

(10) Patent No.: US 12,366,026 B2
(45) Date of Patent: Jul. 22, 2025

(54) LAUNDRY TREATING APPARATUS AND CONTROL METHOD FOR THE SAME

(71) Applicant: LG Electronics Inc., Seoul (KR)

(72) Inventors: Jeongwon Hwang, Seoul (KR); Hongki Choi, Seoul (KR)

(73) Assignee: LG Electronics Inc., Seoul (KR)

( * ) Notice: Subject to any disclaimer, the term of this patent is extended or adjusted under 35 U.S.C. 154(b) by 869 days.

(21) Appl. No.: 17/217,631

(22) Filed: Mar. 30, 2021

(65) Prior Publication Data

US 2021/0301446 A1 Sep. 30, 2021

(30) Foreign Application Priority Data

Mar. 31, 2020 (KR) ..... 10-2020-0039378
Sep. 21, 2020 (KR) ..... 10-2020-0121660

(51) Int. Cl.

| | |
|---|---|
| ***D06F 33/68*** | (2020.01) |
| ***D06F 29/00*** | (2006.01) |
| ***D06F 33/63*** | (2020.01) |
| ***D06F 33/72*** | (2020.01) |
| ***D06F 34/06*** | (2020.01) |
| *D06F 103/04* | (2020.01) |
| *D06F 103/38* | (2020.01) |

(Continued)

(52) U.S. Cl.

CPC ..... *D06F 33/68* (2020.02); *D06F 29/005* (2013.01); *D06F 33/63* (2020.02); *D06F 33/72* (2020.02); *D06F 34/06* (2020.02); *D06F 2103/04* (2020.02); *D06F 2103/38* (2020.02); *D06F 2105/08* (2020.02); *D06F 2105/56* (2020.02)

(58) Field of Classification Search

CPC ..... D06F 33/68; D06F 34/06; D06F 33/63; D06F 33/72; D06F 29/005; D06F 2103/04; D06F 2103/38; D06F 2105/56; D06F 2105/08

USPC ..... 68/12.01

See application file for complete search history.

(56) References Cited

U.S. PATENT DOCUMENTS

| | | | | |
|---|---|---|---|---|
| 2008/0041115 | A1* | 2/2008 | Kanazawa | D06F 34/18 68/12.04 |
| 2015/0368840 | A1 | 12/2015 | Pollett | |
| 2018/0023243 | A1 | 1/2018 | Bae | |

FOREIGN PATENT DOCUMENTS

| | | |
|---|---|---|
| DE | 102017211716 | 1/2019 |
| DE | 102018117110 | 1/2020 |

OTHER PUBLICATIONS

Extended European Search Report in European Appln. No. 21165892.7, dated Jun. 30, 2021, 8 pages.

(Continued)

*Primary Examiner* — Tinsae B Ayalew

(74) *Attorney, Agent, or Firm* — Fish & Richardson P.C.

(57) ABSTRACT

A control method for a laundry treating apparatus comprises a first communication step of notifying a dryer of a washing course by a washing machine if the washing course is input through a washing machine interface provided to receive a control command; a course selection step of selecting any one of a plurality of drying courses set to the dryer by the dryer; and a predicted time transmission step of transmitting a sum of a washing time set to the washing course and a drying time set to the drying course to a terminal provided to perform communication with at least any one of the washing machine and the dryer through wire or wireless communication.

22 Claims, 5 Drawing Sheets

(51) Int. Cl.
*D06F 105/08* (2020.01)
*D06F 105/56* (2020.01)

(56) References Cited

OTHER PUBLICATIONS

Office Action in European Appln. No. 21165892.7, dated Dec. 5, 2023, 5 pages.

* cited by examiner

LAUNDRY TREATING APPARATUS AND CONTROL METHOD FOR THE SAME

CROSS-REFERENCE TO RELATED APPLICATIONS

This application claims the benefit of Korean Patent Application Nos. 10-2020-0039378, filed on Mar. 31, 2020, and 10-2020-0121660, filed on Sep. 21, 2020, the disclosures of which are hereby incorporated by reference as if fully set forth herein.

TECHNICAL FIELD

The present disclosure relates to a laundry treating apparatus and a control method for the same.

BACKGROUND

A laundry treating apparatus collectively refers to a laundry washing apparatus, a laundry drying apparatus, and a laundry washing and drying apparatus.

A laundry treating apparatus of the related art is provided to include a dryer for drying laundry, and a washing machine located on an upper surface of the dryer or provided to support a bottom surface of the dryer and then wash laundry. The laundry treating apparatus in which the dryer and the washing machine are stacked up and down has an advantage in that a user may easily move washed laundry from the washing machine to the dryer.

However, in the aforementioned laundry treating apparatus of the related art, since a controller provided in the dryer and a controller provided in the washing machine operate by their respective circuits independent from each other, a problem occurs in that one apparatus fails to control another apparatus. Therefore, when the operation of any one of the washing machine and the dryer is completed, a problem occurs in that a user should directly perform a process of supplying a power to the other one and a process of inputting a control command.

SUMMARY

Accordingly, the present disclosure is directed to a laundry treating apparatus and a control method for the same, which substantially obviate one or more problems due to limitations and disadvantages of the related art.

An object of the present disclosure is to provide a laundry treating apparatus and a control method for the same, in which one of two treating apparatuses capable of washing and drying laundry may control the other one.

Another object of the present disclosure is to provide a laundry treating apparatus and a control method for the same, in which a time (predicted time) required to completely wash and dry laundry may be notified to a user.

Other object of the present disclosure is to provide a laundry treating apparatus and a control method for the same, in which consumption of a standby power may be minimized.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these objects and other advantages and in accordance with the purpose of the disclosure, as embodied and broadly described herein, the present disclosure provides a control method for a laundry treating apparatus comprising a washing machine provided with a tub in which water is stored and a washing drum provided inside the tub, storing laundry therein, and a dryer provided with a drying drum in which laundry is stored and a supply unit for removing water from laundry by supplying the air to the drying drum.

The control method may comprise a first communication step of notifying the dryer of a washing course by the washing machine if the washing course is input through a washing machine interface provided to receive a control command; a course selection step of selecting any one of a plurality of drying courses set to the dryer by the dryer; and a predicted time transmission step of transmitting a sum of a washing time set to the washing course and a drying time set to the drying course to a terminal provided to perform communication with at least any one of the washing machine and the dryer through wire or wireless communication.

The predicted time transmission step may be provided to transmit a sum of the washing time set to the washing course, the drying time set to the drying course and a sum of the washing time set to the washing course and the drying time set to the drying course.

The control method may further comprise a laundry amount sensing step of measuring the amount of laundry stored in the washing drum if the washing course is input through the washing machine interface, wherein the first communication step may be provided to transmit the washing course and the amount of laundry to the dryer.

The course selection step may be provided to select a drying course for setting the same laundry as washing target laundry set to the washing course as a drying target.

The course selection step may be provided to select a drying course having the lowest power consumption from a plurality of drying courses.

The course selection step may be provided to select a default course of the dryer from a plurality of drying courses.

A predicted time transmitted to the terminal through the predicted time transmission step may be set to be increased in proportion to the amount of laundry.

The predicted time transmission step may be provided to transmit a sum of the washing time, the drying time and additional time set to be increased in proportion to the amount of laundry.

The control method may further comprise a course execution step of sequentially executing a water supply stroke of supplying water to the tub, a particle removal stroke of rotating the washing drum, a drainage stroke of draining water of the tub, and a dehydrating stroke of removing water from laundry by rotating the washing drum, after the laundry amount sensing step is completed; and a drying course setup step of displaying the drying course selected at the course selection step on the dryer interface before the dehydrating stroke is completed after the drainage stroke is initiated.

The control method may further comprise a course execution step of sequentially executing a water supply stroke of supplying water to the tub, a particle removal stroke of rotating the washing drum, a drainage stroke of draining water of the tub, and a dehydrating stroke of removing water from laundry by rotating the washing drum, after the laundry amount sensing step is completed; and a drying course setup step of displaying the drying course selected at the course selection step on the dryer interface if the dehydrating stroke is completed.

The control method may proceed to an interface activation step of supplying a power to the dryer interface if the first communication step is initiated.

In another aspect of the present disclosure, a control method for a laundry treating apparatus comprises a washing standby mode step; a drying standby mode step; a washing machine power supply step of supplying a power to a washing machine first controller, a washing machine driving unit, and a washing machine interface; a first communication step of notifying a dryer second controller dryer of a washing course by a washing machine second controller if a washing course is input through the washing machine interface; a course selection step of allowing the dryer second controller to select any one of a plurality of drying courses executed by the dryer driving unit; and a predicted time transmission step of transmitting a sum of a washing time set to the washing course and a drying time set to the drying course to a terminal provided to perform communication with at least any one of the washing machine first controller, the washing machine second controller, the dryer first controller and the dryer second controller through wire or wireless communication.

In other aspect of the present disclosure, a control method for a laundry treating apparatus comprises a washing standby mode step of supplying a power to a washing machine second controller controlling a washing machine interface and a washing machine power controller controlling power supply of a washing machine first controller without supplying the power to a washing machine driving unit, a washing machine interface and the washing machine first controller controlling the washing machine driving unit; a drying standby mode step of supplying the power to a dryer second controller controlling a dryer interface and a dryer power controller controlling a power of a dryer first controller without supplying the power to a dryer driving unit, the dryer interface and the dryer first controller controlling the dryer driving unit; a washing machine power supply step of supplying the power to the washing machine first controller, the washing machine driving unit and the washing machine interface in accordance with a control signal of the washing machine power controller; a first communication step of notifying the dryer second controller of a washing course by the washing machine second controller if the washing course is input through the washing machine interface; a course selection step of allowing the dryer second controller to select any one of a plurality of drying courses executed by the dryer driving unit; and a predicted time transmission step of transmitting a sum of a washing time set to the washing course and a drying time set to the drying course to a terminal provided to perform communication with at least any one of the washing machine first controller, the washing machine second controller, the dryer first controller and the dryer second controller through wire or wireless communication.

The control method may further comprise a laundry amount sensing step of measuring the amount of laundry stored in a washing drum by controlling the washing machine driving unit if the washing course is input through the washing machine interface, wherein the first communication step may be provided to transmit the washing course and the amount of laundry to the dryer second controller.

The course selection step may be provided to select a drying course set to dry the same kind of laundry as a kind of laundry washed in the washing course.

The course selection step may be provided to select a drying course set to have the lowest power consumption from a plurality of drying courses executed by the dryer driving unit.

The course selection step may be provided to select a default course of the dryer from a plurality of drying courses executed by the dryer driving unit.

A predicted time transmitted to the terminal through the predicted time transmission step may be set to be increased in proportion to the amount of laundry.

The predicted time may be set by a sum of the washing time, the drying time and a preset additional time.

The additional time may be set to 10 minutes to 20 minutes.

The control method may further comprise a course execution step of sequentially executing a water supply stroke of supplying water to a tub, a particle removal stroke of rotating a washing drum rotatably provided inside the tub, a drainage stroke of draining water of the tub, and a dehydrating stroke of removing water from laundry by rotating the washing drum, after the laundry amount sensing step is completed; and a drying course setup step of displaying the drying course selected at the course selection step by the dryer second controller on the dryer interface before the dehydrating stroke is completed after the drainage stroke is initiated.

The control method may further comprise a course execution step of sequentially executing a water supply stroke of supplying water to a tub, a particle removal stroke of rotating a washing drum rotatably provided inside the tub, a drainage stroke of draining water of the tub, and a dehydrating stroke of removing water from laundry by rotating the washing drum, after the laundry amount sensing step is completed; and a drying course setup step of displaying the drying course selected at the course selection step by the dryer second controller on the dryer interface if the dehydrating stroke is completed.

The control method may be provided to resume the drying standby mode if an execution request command of a drying course set for a preset reference time is not input after the drying course setup step is completed.

According to the present disclosure, a laundry treating apparatus and a control method for the same may be provided, in which one of two treating apparatuses capable of washing and drying laundry may control the other one.

Also, according to the present disclosure, a laundry treating apparatus and a control method for the same may be provided, in which a time (predicted time) required to completely wash and dry laundry may be notified to a user.

Also, according to the present disclosure, a laundry treating apparatus and a control method for the same may be provided, in which consumption of a standby power may be minimized.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Reference will now be made in detail to the preferred embodiments of the present disclosure, examples of which are illustrated in the accompanying drawings. Meanwhile, elements or control method of apparatuses which will be described below are only intended to describe the embodiments of the present disclosure and are not intended to restrict the scope of the present disclosure. Wherever possible, the same reference numbers will be used throughout the drawings to refer to the same or like parts.

Figure 1:
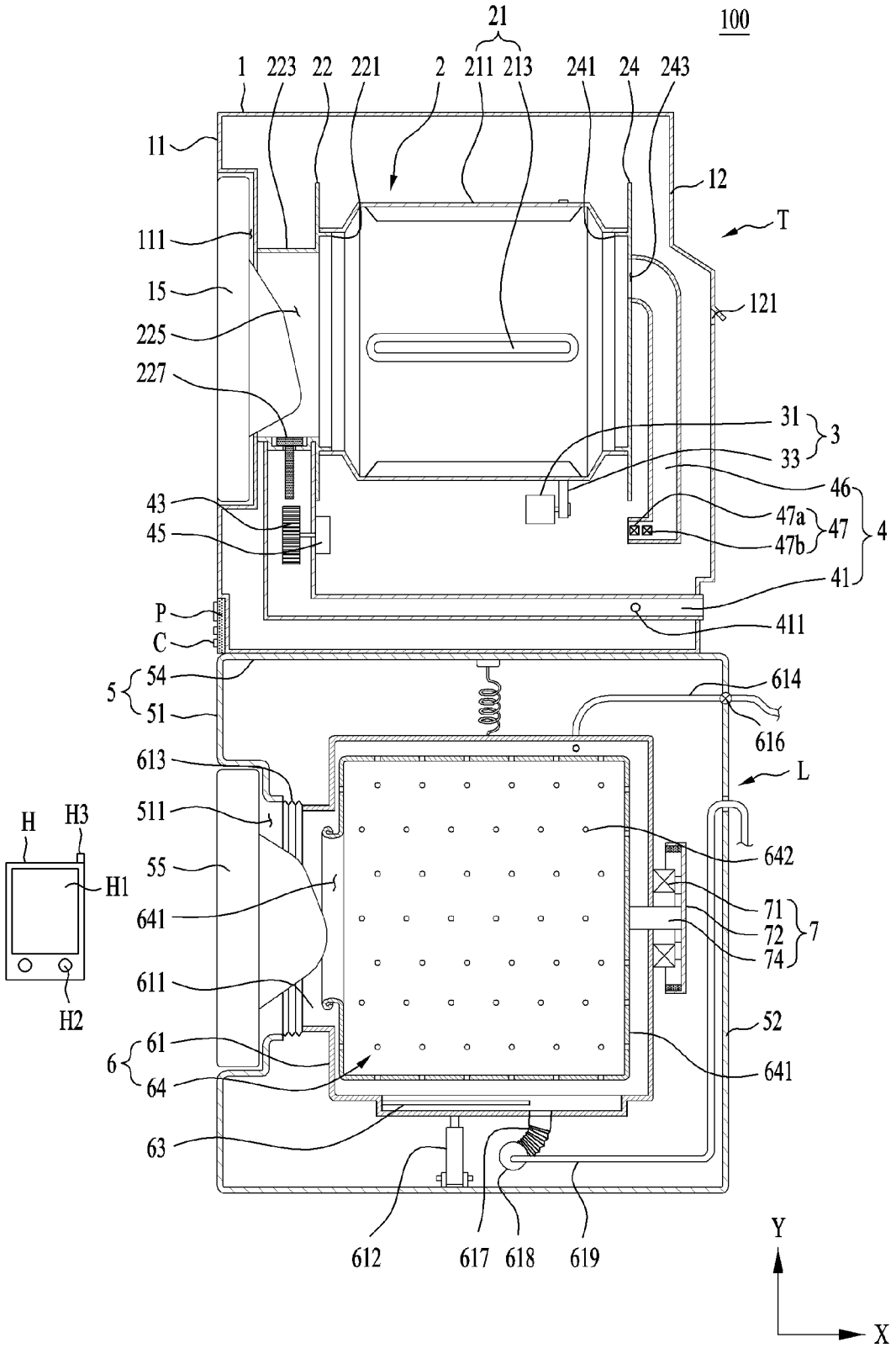
FIG. 1 illustrate an example of a laundry treating apparatus.

As shown in FIG. 1, a laundry treating apparatus 100 may be provided to include a dryer (first treating apparatus T) for drying laundry, and a washing machine (second treating apparatus L) provided to support a bottom surface of the dryer and therefore wash or dry laundry. Unlike the case shown in FIG. 1, the laundry treating apparatus 100 may be provided such that the dryer T may support a bottom surface of the washing machine L.

The laundry treating apparatus 100 is provided with a terminal H (cellular phone, etc.) that may perform communication with any one of the dryer T and the washing machine L. The terminal H may be provided to implement a function of transmitting a control command to each of the apparatuses T and L and a function of displaying information transmitted from each of the apparatuses T and L. That is, the terminal H may be provided to include a terminal communication unit H3 enabling communication (wire communication or wireless communication) with each apparatus, a terminal display unit H1 on which information transmitted from each apparatus to the terminal is displayed, and a terminal input unit H2 to which a control command from a user is input.

The dryer T includes a first cabinet 1, a drying drum 2 rotatably provided in the first cabinet 1, providing a space in which laundry is stored, and a supply unit 4 supplying the heated air into the drying drum 2.

The first cabinet 1 may be provided to include a front panel 11 (first front panel) forming a front surface of the dryer, a rear panel 12 (first rear panel) forming a rear surface of the dryer, an upper panel forming an upper surface of the dryer, and a base panel mounted on an upper surface of the washing machine L.

The first front panel 11 is provided with a first inlet 111 provided to be communicated with the drying drum 2, and the first inlet 111 may be provided to be opened or closed by a door 15 (first door) rotatably coupled to the first cabinet.

The drying drum 2 may be provided as a drum body 21 of a cylindrical shape of which front surface and rear surface are respectively opened. In this case, a front support 22 rotatably supporting the front surface of the drum body 211 and a rear support 24 rotatably supporting the rear surface of the drum body 211 may be provided inside the first cabinet 1.

The front support 22 may be provided to include a first fixed body fixed into the first cabinet 1, a drying drum inlet 225 provided to pass through the first fixed body, communicating the first inlet 111 with the inside of the drum body 21, and a first support body 221 provided in the first fixed body and inserted into the front surface of the drum body 21.

The first fixed body may be provided even in any shape if it may be provided with the drying drum inlet 225 and the first support body 221. The first support body 221 may be provided in a pipe shape protruded from the first fixed body toward the drum body 21.

The front support 22 may be provided to be connected to the first inlet 111 through a connecting body 223. The connecting body 223 may be provided in a cylindrical shape to surround the first inlet 111. In this case, the drying drum inlet 225 may be provided as a through hole connected to the first inlet 111 by passing through the connecting body 223.

A discharge outlet communicated with the supply unit 4 may be provided in the connecting body 223. The discharge outlet may be provided as a hole provided to pass through the connecting body 223, and a filter 227 may detachably be inserted into the discharge outlet. The air inside the drum body 21 may move to the supply unit 4 through the discharge outlet and the filter 227, and particles contained in the air in this process may be filtered by the filter 227.

The rear support 24 may be provided to include a second fixed body fixed into the first cabinet 1, and a second support body 241 provided in the second fixed body and inserted into the rear surface of the drum body 21. The rear support 24 is provided with a supply hole 243 provided to pass through the second fixed body, guiding the air supplied from the supply unit 4 to the drum body 21.

A lifter 213 for stirring of laundry may be provided on a circumferential surface of the drum body 21. The lifter 213 may be provided as a board protruded from the circumferential surface of the drum body 211 toward a rotation center of the drum body.

The drum body 21 is rotated by a drying drum driving unit 3, and the drying drum driving unit 3 may be provided to include a drying drum motor 31 fixed into the first cabinet 1, a pulley rotated by the drying drum motor, and a belt 33 connecting a circumferential surface of the pulley with the circumferential surface of the drum body 21.

The supply unit 4 may be provided to include ducts 41 and 46 and a heat exchanger 47 provided in the ducts to exchange heat with the air. The ducts may be provided to include a discharge duct 41 guiding the air discharged from the drying drum 2 to the outside of the first cabinet 1 through the discharge outlet, and a supply duct 46 supplying the air to the inside of the drying drum 2 through the supply hole 243.

The discharge duct 41 may be provided with fans 43 and 45, and the supply duct 46 may be provided with the heat exchanger 47. The heat exchanger 47 may be provided as a heater for heating the air entering the supply duct 46. FIG. 1 illustrates that the heater is provided with a first heater 47*a* and a second heater 47*b*, which may be controlled independently, as an example. The fans may be provided to include an impeller 43 rotatably provided inside the discharge duct 41, and a fan motor 45 rotating the impeller if a power is supplied thereto. The discharge duct 41 may be provided with a temperature sensor 411 for measuring a temperature of the air discharged from the drying drum 3.

The supply duct 46 may be provided as a path of which one end is connected to the supply hole 243 and free end is arranged inside or outside the first cabinet 1. If the free end of the supply duct 46 is arranged inside the first cabinet 1, a through hole 121 may be provided in the first rear panel 12.

The washing machine L may be provided to include a second cabinet 5 provided to support a bottom surface of the first cabinet 1, and a second accommodating unit 6 provided inside the second cabinet, providing a space in which laundry is stored.

The second cabinet 5 may be provided to include a front panel 51 (second front panel) forming a front surface of the washing machine L, a rear panel 52 (second rear panel) forming a rear surface of the washing machine, and an upper panel 54 (second upper panel) forming an upper surface of the washing machine, providing a space on which the bottom surface of the first cabinet 1 is supported.

The second front panel 51 is provided with an inlet 511 (second inlet), and the second inlet 511 may be provided to be opened or closed by a door 55 (second door). The second accommodating unit 6 may be provided to include a tub 61 provided inside the second cabinet 5, providing a space in which water is stored, and a washing drum 64 rotatably provided inside the tub, storing laundry therein.

The tub 61 may be fixed to the second cabinet 5 through a tub support 612. A tub inlet 611 communicated to the second inlet 511 is provided on a front surface of the tub 61, and may be connected to the second inlet 511 through a gasket 613.

The tub 61 is supplied with water through a water supply unit, and water stored in the tub 61 is discharged to the outside of the second cabinet 5 through a drainage unit.

The water supply unit may be provided to include a water supply pipe 614 connecting a water supply source with the tub 61, and a water supply valve 616 controlling switching of the water supply pipe. The drainage unit may be provided to include a first drainage pipe 617 guiding water inside the tub 61 to the drainage pump 618, and a second drainage pipe 619 guiding water discharged from the drainage pump 618 to the outside of the second cabinet 5. The tub 61 may be provided with a heating unit 63 for heating the water supplied through the water supply source.

The washing drum 64 may be provided in a hollow cylindrical shape. A washing drum inlet 641 communicated with the second inlet 511 through the tub inlet 611 may be provided on the front surface of the washing drum, and a drum through hole 642 communicating the inside of the washing drum with the inside of the tub may be provided on the circumferential surface and the rear surface of the washing drum.

The washing drum 64 may be rotated by a washing drum driving unit 7 (washing drum motor). The washing drum driving unit 7 may be provided to include a stator 71 fixed to the rear surface of the tub 61, forming a rotating magnetic field, a rotor 72 rotated by the rotating magnetic field, and a rotary shaft 74 connecting the rotor 72 with the rear surface of the washing drum 64 by passing through the rear surface of the tub.

Figure 2:
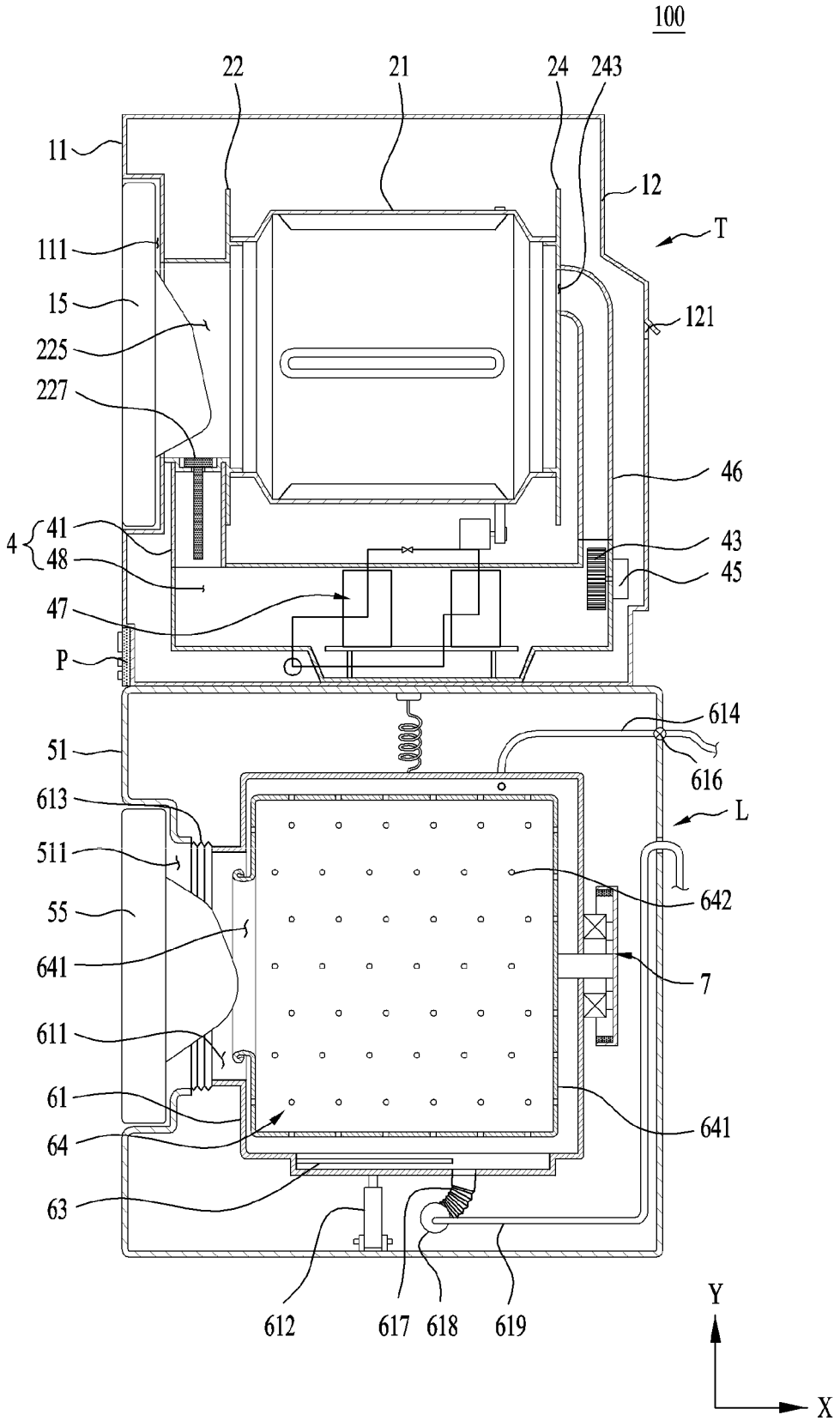
FIGS. 2 and 3 illustrates another embodiment of a laundry treating apparatus.

FIG. 2 illustrates another embodiment of the laundry treating apparatus 100, and the laundry treating apparatus according to this embodiment is also provided to include a dryer T and a washing machine L. The laundry treating apparatus provided in this embodiment may be provided in the same structure as that of the laundry treating apparatus shown in FIG. 1 except the structure of the supply unit 4 provided in the dryer.

The supply unit 4 according to this embodiment may be provided to include ducts 41, 46 and 48 forming a path for re-supplying the air discharged from the drum body 21 to the drum body 21, and a heat exchanger 47 dehumidifying and heating the air entering the ducts.

The ducts may be provided to include a discharge duct 41 connected to the discharge outlet, a supply duct 46 connected to the supply hole 243, and a connection duct 48 connecting the discharge duct with the supply duct. In this case, the impeller 43 of the fan may be provided inside the connection duct 48.

Figure 3:
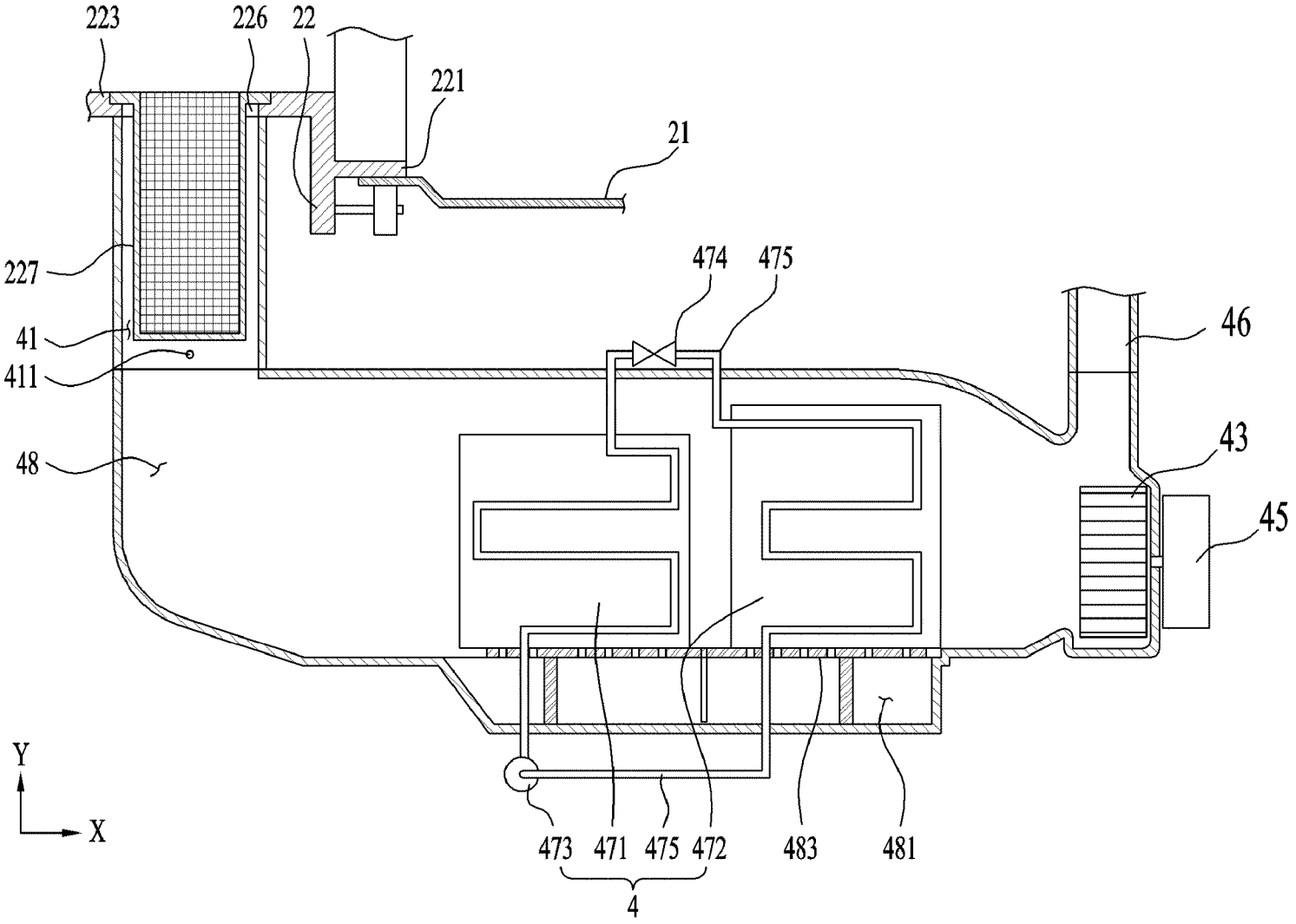

As shown in FIG. 3, the heat exchanger 47 includes a first heat exchanger 471 (heat absorption unit) removing water from the air entering the connection duct 48, and a second heat exchanger 472 (heat emission unit) provided inside the connection duct 48, heating the air passing through the first heat exchanger 471. The heat absorption unit 471 and the heat emission unit 472 are sequentially disposed along a moving direction of the air and connected with each other through a refrigerant pipe 475 that forms a circulating path of a refrigerant.

The refrigerant moves along the refrigerant pipe 475 by means of a compressor 473 arranged outside the ducts 41, 46 and 48, and the refrigerant pipe 475 is provided with a pressure controller 474 for controlling a pressure of the refrigerant that has passed through the heat emission unit 472.

The heat absorption unit 471 is a means for cooling the air and evaporating the refrigerant by delivering heat of the air entering the discharge duct 41 to the refrigerant. The heat emission unit 472 is a means for heating the air and condensing the refrigerant by delivering heat owned by the refrigerant that has passed through the compressor 473 to the air. In this case, water contained in the air will be collected in the bottom surface of the connection duct 48 along the surface of the heat absorption unit 471 when passing through the heat absorption unit 471.

In order to collect water removed from the air passing through the heat absorption unit 471, the dryer T is provided with a water collecting body 481. The water collecting body 481 may be provided anywhere in the laundry treating apparatus, which can store water discharged from the heat absorption unit, and FIG. 3 illustrates that the water collecting body 481 is provided to be communicated with the bottom surface of the connection duct 48, as an example.

A heat exchanger support 483 may further be provided in the water collecting body 481 such that the heat absorption unit 471 and the heat emission unit 472 are not in contact with the water (condensed water) stored in the water collecting body 481.

Figure 4:
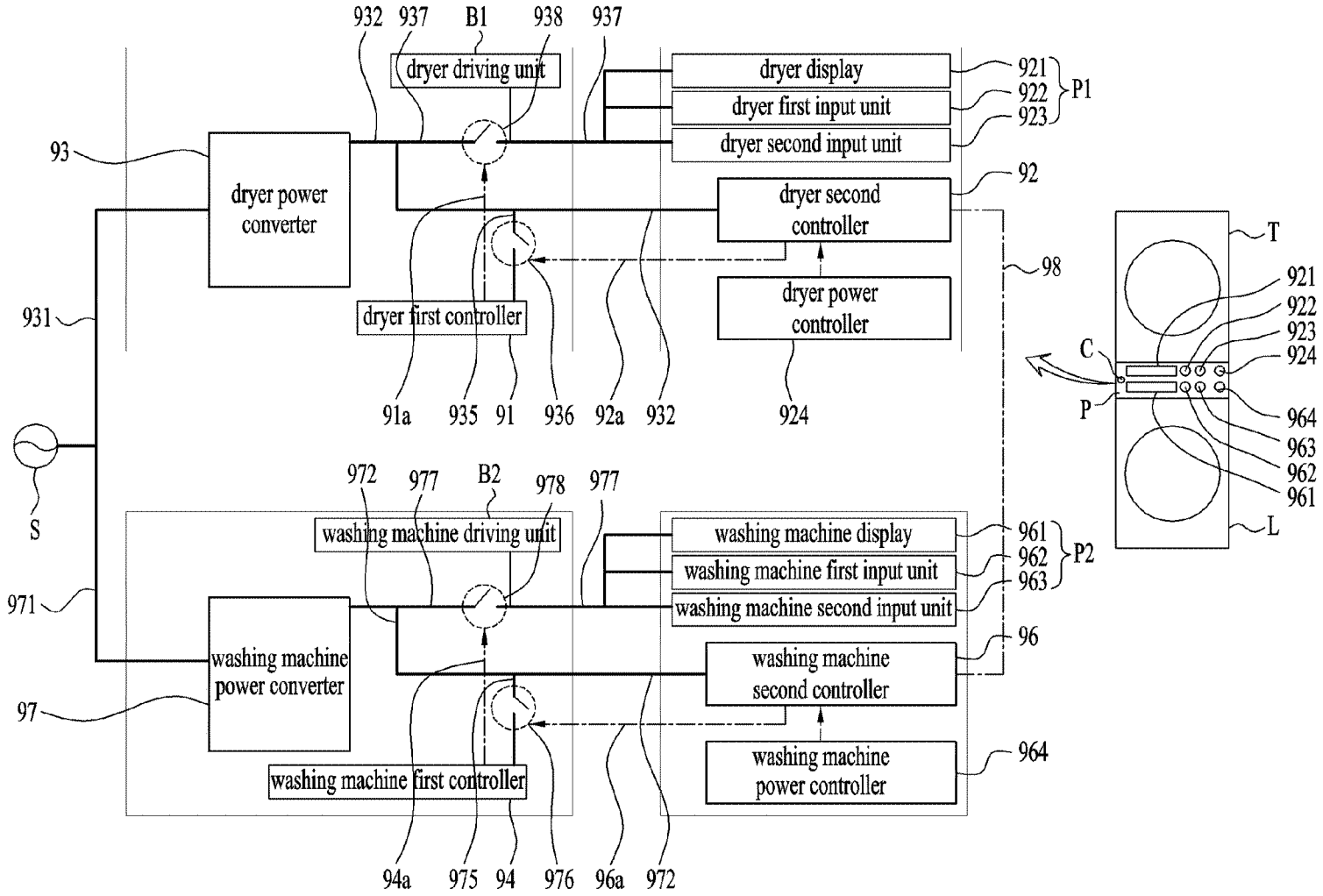
FIG. 4 illustrates an example of a control panel, a washing machine driving unit, a dryer driving unit, a washing machine interface and a dryer interface, which are provided in a laundry treating apparatus.

The aforementioned laundry treating apparatus 100 should be provided with an input unit and a display unit, which are required for control of each of the apparatuses T and L. That is, as shown in FIG. 4, the dryer T is provided with a dryer interface P1, and the washing machine is provided with a washing machine interface P2.

The dryer interface P1 may be provided to include a dryer display 921 and dryer input units 922 and 923, and the washing machine interface P2 may be provided to include a washing machine display 961 and washing machine input units 962 and 963.

The dryer display 921 is a means for displaying a control command capable of being input to the dryer T or a control command input to the dryer T, and the dryer input units 922 and 923 are means for inputting the control command to the dryer T. Likewise, the washing machine display 961 is a means for displaying a control command capable of being input to the washing machine L or a control command input to the washing machine L, and the washing machine input units 962 and 963 are means for inputting the control command to the washing machine L.

In order to form unity in design of the laundry treating apparatus 100 in which two treating apparatuses are arranged up and down, the dryer display 921, the dryer input units 922 and 923, the washing machine display 961 and the washing machine input units 962 and 963 may be provided in one control panel P.

The control panel P may be provided such that an upper surface is fixed to the front surface (the first front panel) of the dryer and a lower surface is fixed to the front surface (the second front panel) of the washing machine. In this case, the control panel P will serve as a fastening unit for fixing the dryer T to the washing machine L (serve to fasten the first front panel with the second front panel).

Unlike the aforementioned description, the control panel P may be provided to be fixed to any one of the first front panel 11 and the second front panel 51. FIGS. 1 and 2 show that the control panel P is fixed to a lower end of the first front panel 11, as an example. That is, a panel accommodating groove formed as the surface of the first front panel is bent to be concave is provided on the lower end of the first front panel 11, and the control panel P may be fixed to the panel accommodating groove. In this case, the control panel P will form the front surface of the dryer together with the first front panel 11.

The dryer display 921 and the dryer input units 922 and 923 are controlled by a second controller 92 provided in the dryer, and the washing machine display 961 and the washing machine input units 962 and 963 are controlled by a second display controller 96 provided in the washing machine. The case that the second controller controls the display and the input units means that the second controller and each apparatus are provided to transmit and receive a control command (or control signal) to and from each other. The second controller 92 of the dryer and the second controller 96 of the washing machine may be provided to be communicated with each other through a communication circuit 98.

The dryer input unit may be provided to include a dryer first input unit 922 and a dryer second input unit 923. The dryer first input unit 922 may be provided as a means for selecting any one of control commands (drying courses) that can be executed by the dryer, and the dryer second input unit 923 may be provided as a means for executing the selected control command or inputting a control command requesting a temporary stop of the control command which is being executed.

The washing machine input unit may be provided to include a washing machine first input unit 962 and a washing machine second input unit 963. The washing machine first input unit 962 may be provided as a means for selecting any one of control commands (washing courses) that can be executed by the washing machine, and the washing machine second input unit 963 may be provided as a means for executing the selected control command or inputting a control command requesting a temporary stop of the control command which is being executed.

Moreover, at least one of the dryer second controller 92 and the washing machine second controller 96 may perform communication with the terminal H through a communication unit C. If each of the dryer second controller 92 and the washing machine second controller 96 is provided to perform communication with the terminal H, the communication unit C may be provided to include a dryer communication unit (means for communication between the dryer second controller and the terminal) and a washing machine communication unit (means for communication between the washing machine second controller and the terminal).

Load of the dryer is classified into driving load and interface load, wherein the driving load (dryer driving load) is a dryer driving unit B1 comprised of the drying drum motor 31, the fan motor 45, the heat exchanger 47, the temperature sensor 411 and the dryer communication unit, and the interface load (dryer interface load) is a dryer interface P1 comprised of the dryer display 921 and the dryer input units 922 and 923.

A power of the dryer load B1 and P1 may be provided to be controlled by a dryer first controller 91. However, the operation of the dryer driving unit B1 may be controlled by the dryer first controller 91 and the operation of the dryer interface P1 may be controlled by the dryer second controller 92.

The dryer T is connected to a power source S through a first power line 931, and may be provided such that an alternating current power supplied to the first power line 931 is converted to a direct current power through a first converter 93 (dryer power converter). In this case, the dryer second controller 92 may be provided to be supplied with a power through a dryer first power circuit 932 connected to the first converter 93, the dryer first controller 91 may be provided to be supplied with a power through a dryer second power circuit 935, and the dryer driving unit B1 and the dryer interface P1 may be provided to be supplied with a power through a dryer third power circuit 937.

The dryer second power circuit 935 may be provided with a dryer first switch 936, and the dryer third power circuit 937 may be provided with a dryer second switch 938. The dryer first switch 936 may be provided to open or close the dryer second power circuit 935 in accordance with a control command of the dryer second controller 92 or a control command of the dryer power controller 924. The dryer power controller 924 may be provided in the control panel P and provided as a means for controlling power supply to the dryer driving unit B1 and the dryer interface P1.

If the dryer power controller 924 transmits a control command requesting power supply to the dryer second controller 92 (if a user inputs a power supply request signal through the dryer power controller), the dryer second controller 92 controls the dryer first switch 936 to close the dryer second power circuit 935 through the dryer first switch control circuit 92*a*. If the dryer first switch 936 closes the dryer second power circuit 935, the dryer first controller 936 may be supplied with a power.

Meanwhile, the dryer second switch 938 may be provided to open or close the dryer third power circuit 937 in accordance with the control command transmitted from the dryer first controller 91 through the second switch control circuit 91*a*, or may be provided to open or close the dryer third power circuit 937 in accordance with the control command transmitted from the dryer second controller 92. The dryer driving unit B1 and the dryer interface P1 may be supplied with a power when the dryer second switch 938 closes the dryer third power circuit 937.

The dryer second controller 92 and the dryer power controller 924 are always connected with a power source through the dryer first power circuit 932. However, the dryer driving unit B1 and the dryer interface P1 will be supplied with a power when a user inputs a control command to the dryer power controller 924 or when the dryer second controller 92 receives a control command from the washing machine second controller 96.

Since the dryer T of the aforementioned structure supplies a power to only the dryer second controller 92 and the dryer power controller 924 when the dryer driving unit and the interfaces B1 and P1 are not operated, consumption of a standby power may be minimized.

Load of the washing machine L is classified into driving load and interface load, wherein the driving load of the washing machine is a washing machine driving unit B2 comprised of the washing drum driving unit 7, a water supply valve 616, a drainage pump 618, a heating unit 63 and the washing machine communication unit, and the interface load of the washing machine is a washing machine interface P2 comprised of the washing machine display 961 and the washing machine input units 962 and 963.

A power of the washing machine load B2 and P2 may be provided to be controlled by a washing machine first controller 94. The operation of the washing machine driving unit B2 may be controlled by the washing machine first controller 94 and the operation of the washing machine interface P2 may be controlled by the washing machine second controller 96.

The washing machine L is connected to the power source S through a second power line 971, and may be provided such that an alternating current power supplied to the second power line 971 is converted to a direct current power through a second converter 97 (washing machine converter). The power line 931 of the dryer T and the power line 971 of the washing machine L are provided separately (independently) from each other, whereby even though any one of the two power lines is damaged or any one of the two apparatuses is out of order, the other one may be operated.

The washing machine second controller 96 may be provided to be supplied with a power through a washing machine first power circuit 972 connected to the second converter 97, the washing machine first controller 94 may be provided to be supplied with a power through a washing machine second power circuit 975, and the loads B2 and P2 of the washing machine may be provided to be supplied with a power through a washing machine third power circuit 977.

The washing machine second power circuit 975 may be provided with a washing machine first switch 976, and the washing machine first switch 976 may be provided to open or close the washing machine second power circuit 975 in accordance with the control command of the washing machine second controller 96 or the control command of the washing machine power controller 964. The washing machine power controller 964 may be provided in the control panel P1 and thus may be provided as a means for controlling power supply to the washing machine driving unit B2 and the washing machine interface P2.

If the washing machine power controller 964 transmits a control command requesting power supply to the washing machine second controller 96 (if a user inputs a power supply request signal through the washing machine power controller), the washing machine second controller 96 controls the washing machine first switch 976 to close the washing machine second power circuit 975 through the washing machine first switch control circuit 96*a*. If the washing machine first switch 976 closes the washing machine second power circuit 975, the washing machine first controller 94 will be supplied with a power.

Meanwhile, the washing machine second switch 978 may be provided to open or close the washing machine third power circuit 977 in accordance with the control signal transmitted from the washing machine first controller 94 through the washing machine second switch control circuit 94*a*, or may be provided to open or close the washing machine third power circuit 977 in accordance with the control command transmitted from the washing machine second controller 96. The washing machine driving unit B2 and the washing machine interface P2 will be supplied with a power when the washing machine second switch 978 closes the washing machine third power circuit 977.

The washing machine second controller 96 and the washing machine power controller 964 are always connected with a power source through the washing machine first power circuit 972. However, the washing machine driving unit B2 and the washing machine interface P2 will be supplied with a power when a user inputs a control command to the washing machine power controller 964 or when the washing machine second controller 96 receives a control command from the dryer first controller 92.

Figure 5:
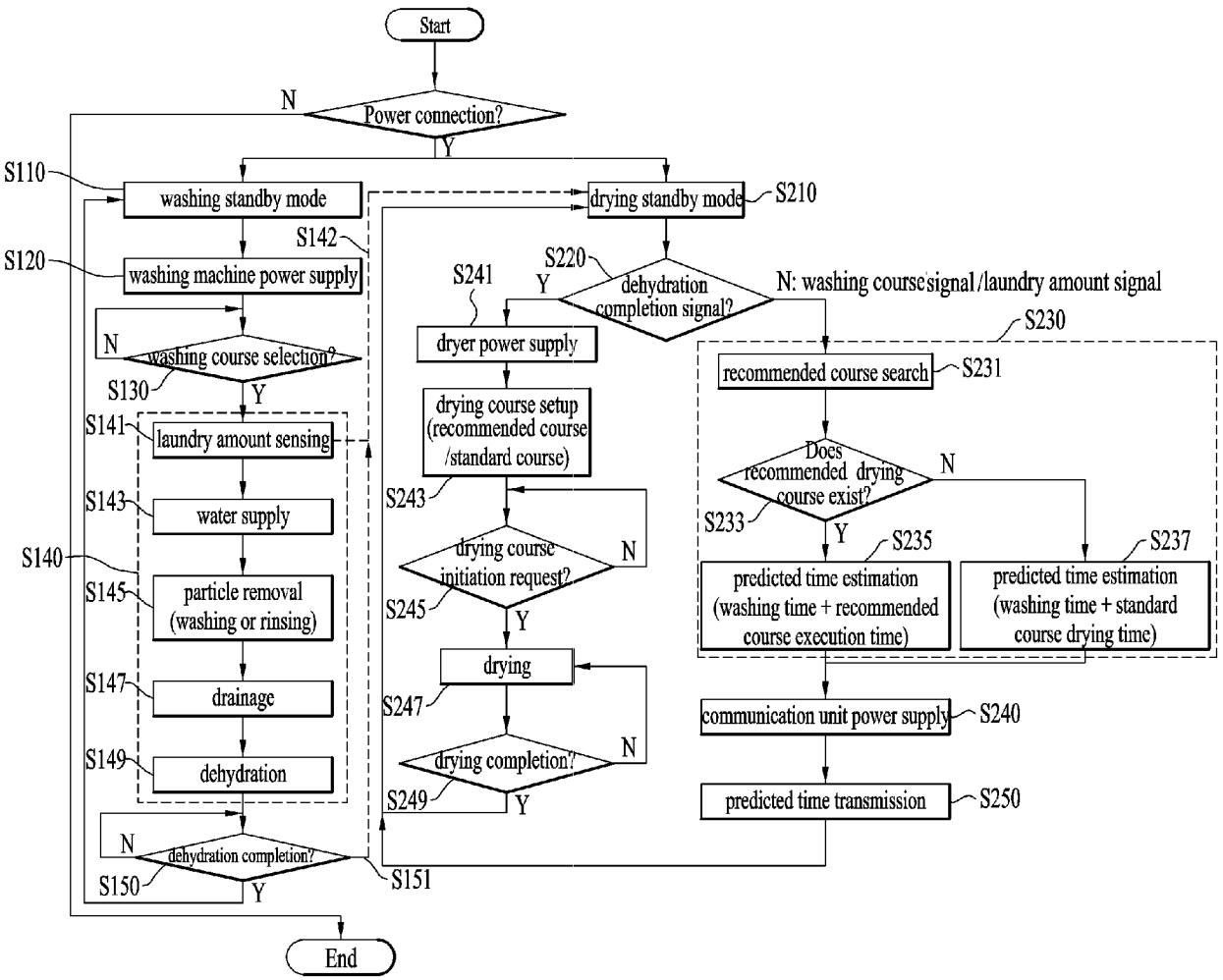
FIG. 5 illustrates an example of a control method for a laundry treating apparatus.

FIG. 5 illustrates an example of a control method for the aforementioned laundry treating apparatus 100.

As shown, if the first power line 931 and the second power line 971 are respectively connected to the power source S, the laundry treating apparatus 100 proceeds to a washing standby mode step S110 and a drying standby mode step S210.

The washing standby mode step S110 is the step of supplying a power to the washing machine second controller 96 and the washing machine power controller 964 without supplying the power to the washing machine driving unit B2, the washing machine interface P2 and the washing machine first controller 94. That is, at the washing standby mode step S110, the washing machine first switch 976 maintains the state that the washing machine second power circuit 975 is opened, and the washing machine second switch 978 maintains the state that the washing machine third power circuit 977 is opened.

The washing machine power controller 964 may be provided as a switch that may operate the washing machine first switch 976 even though a power is not supplied thereto. In this case, the washing standby mode step S110 will be the step of supplying a power to the washing machine second controller without supplying the power to the washing machine driving unit, the washing machine interface and the washing machine first controller.

The drying standby mode step S210 is the step of supplying a power to the dryer second controller 92 and the dryer power controller 924 without supplying the power to the dryer driving unit B1, the dryer interface P1 and the dryer first controller 91. That is, at the drying standby mode step S210, the dryer first switch 936 maintains the state that the dryer second power circuit 935 is opened, and the dryer second switch 938 maintains the state that the dryer third power circuit 937 is opened.

The dryer power controller 924 may be provided as a switch that may operate the dryer first switch 936 even though a power is not supplied thereto. In this case, the drying standby mode step S210 will be the step of supplying a power to the dryer second controller without supplying the power to the dryer driving unit, the dryer interface and the dryer first controller.

If a control signal requesting power supply is input to the washing machine load through the washing machine power controller 964 in the middle of the washing machine standby mode step S110, a washing machine power supply step S120 is executed. The washing machine power supply step S120 is the step of supplying a power to the washing machine first controller 94, the washing machine driving unit B2 and the washing machine interface P2.

If the washing machine power supply step S120 is completed, the control method determines whether a washing course has been input to the washing machine interface P2 (S130). If a selection command of the washing course is input through the washing machine first input unit 962 and a start command of the selected washing course is input through the washing machine second input unit 963, the control method proceeds to a course execution step S140 by controlling the washing machine driving unit B2.

The course execution step S140 may be provided to perform a laundry amount sensing stroke S141, a water supply stroke S143, a particle removal stroke S145, a drainage stroke S147 and a dehydrating stroke S149 in due order.

The laundry amount sensing stroke S141 is a process of determining the amount of laundry (washing target) inserted into the washing drum 64 by the washing machine first controller 94. The laundry amount sensing stroke S141 may be provided with a process of determining the amount of laundry through the amount of a current supplied to the stator 71 while the washing drum 64 is being accelerated for the number of preset revolutions or is being rotated to reach a preset angle. In this case, the washing machine L may be provided with a current amount sensor (not shown) for measuring the amount of a current supplied to the stator 71.

The water supply stroke S143 may be provided as a stroke of supplying water to the tub 61 by controlling the water supply valve 616 by the washing machine first controller 94, and the particle removal stroke S145 may be provided as a stroke of rotating the washing drum 64 by controlling the washing drum driving unit 7 by the washing machine first controller 94. The particle removal stroke S145 is the step of separating particles from laundry, and may be an example of a washing stroke or a rinsing stroke.

The drainage stroke S147 may be provided as a stroke of discharging water stored in the tub 61 to the outside of the second cabinet 5 by controlling the drainage pump 618 by the washing machine first controller 94, and the dehydrating stroke S149 may be provided as a stroke of removing water from laundry by controlling the washing drum driving unit 7 by the washing machine first controller 94. If the dehydrating stroke ends (S150) (the course execution step ends), the control method resumes the washing standby mode step S110 and switches the washing machine L to a standby mode state.

If the time (predicted time) predicted to dry the completely washed laundry by the dryer T may be notified to a user, the user may arrange a schedule in consideration of the time when drying is completed or determine whether to operate the dryer in consideration of the schedule.

In order to implement the aforementioned effect, the control method proceeds to a first communication step S142 for notifying the dryer second controller 92 of at least any one of the washing course and the amount of laundry inserted into the washing drum by the washing machine second controller 96. At the first communication step S142, the washing machine second controller 96 and the dryer second controller 92 perform communication with each other through the communication circuit 98.

If the first communication step S142 is executed after the washing course input step S130 is completed, the washing machine second controller 96 will transmit only information on the washing course to the dryer second controller 92. However, if the first communication step S142 is executed after the laundry amount sensing stroke S141 is completed, the washing machine second controller 96 may transmit information on the washing course and the amount of laundry to the dryer second controller 92.

If the information on the washing course or the information on the washing course and the amount of laundry is transmitted to the dryer second controller 92 through the first communication step S142, the dryer may be switched from the drying standby mode step S210 to an interface activation step for supplying a power to the dryer interface P1. This is to allow a user to recognize mutual action between the washing machine and the dryer. The interface activation step may be set to a step of supplying a power to the dryer interface P1, the dryer second controller 92 and the dryer power controller 924 without supplying the power to the dryer driving unit B1 and the dryer first controller 91.

If the information on the washing course or the information on the washing course and the amount of laundry is transmitted to the dryer second controller 92 through the first communication step S142, the control method proceeds to a course selection step S230 of selecting a drying course, which corresponds to a washing course executed by the washing machine L, from a plurality of drying courses.

The course selection step S230 includes recommended course search steps S231 and S233 of searching for a drying course (recommended course), which corresponds to the washing course selected at the washing course selection step S130, among the plurality of drying courses set to the dryer T, a first predicted time estimation step S235 of estimating a sum of an execution time of the washing course and an execution time of the recommended course if the recommended course exists, and a second predicted time estimation step S237 of estimating a sum of the execution time of the washing course and an execution time of a default course set to the dryer if the recommended course does not exist. The default course means a drying course to the dryer when a power is supplied to the dryer interface P1, and may include a standard course as an example.

The recommended course may be set to a drying course set to dry laundry that is the same kind of laundry as that washed through the washing course. That is, if the washing course is a wool washing course, the recommended course may be set to a wool drying course, if the washing course is a cotton washing course, the recommended course may be set to a cotton drying course, and if the washing course is a functional laundry washing course, the recommended course may be set to a functional laundry drying course. Unlike the aforementioned case, the recommended course may be set to a course having the lowest power consumption among the drying courses (a plurality of courses executed by the dryer driving unit) set to the dryer T.

Considering that a user should move laundry stored in the washing drum to the drying drum if washing is completed, the first predicted time estimation time S235 may be provided with a step of estimating a sum of the time (washing time) set to the washing course, the time (drying time) set to the recommended course and a preset additional time. The second predicted time estimation time S237 may be provided with a step of estimating a sum of a washing time, the execution time of the default course and additional time. The predicted time set through each of the steps S235 and S237 may be set to be increased in proportion to the amount of laundry notified to the dryer T through the first communication step S142.

The additional time may be set to 10 minutes to 20 minutes, or may be provided to be varied depending on a user's selection. In the latter case, the user may set the additional time through any one of the terminal input unit H2, the dryer input unit and the washing machine input unit.

If the course selection step S230 is completed, the control method proceeds to a communication unit power supply step S240 of supplying a power the communication unit C, and a predicted time transmission step S250 of transmitting the predicted time to the terminal H.

As described above, the communication unit C may be provided with a dryer communication unit and a washing machine communication unit. In this case, the communication unit power supply step S240 may be provided with only a step of supplying a power to the dryer communication unit by the dryer first controller 91, or may be provided with only a step of supplying a power to the washing machine communication unit by the washing machine first controller 94.

The predicted time transmission step S250 is the step of transmitting a predicted time calculated by the predicted time estimation steps S235 and S237 to the terminal H by any one of the washing machine L and the dryer T. That is, the predicted time transmission step S250 is the step of transmitting the predicted time to the terminal H by any one of the dryer first controller 91, the dryer second controller 92, the washing machine first controller 94 and the washing machine second controller 96 through the communication unit C. If the predicted time transmission step S250 is completed, the control method resumes the drying standby mode step S210.

The control method may execute a second communication step S151 of transmitting a control signal to the dryer second controller 92 by the washing machine second controller 96 in the middle of the drying standby mode step S210.

The second communication step S151 may be initiated when the dehydrating stroke S149 ends (when the course execution step ends), or may be provided to be executed before the dehydrating stroke S159 ends after the drainage stroke S147 is initiated. FIG. 5 illustrates the former case as an example.

If the dryer second controller 92 receives a dehydration completion signal from the washing machine second controller 96 through the second communication step S151, the control method proceeds to a dryer power supply step S241 of supplying a power to the dryer loads B1 and P1 and a drying course setup step S243 of displaying the drying course selected at the course selection steps S231 and S233 on the dryer interface P1.

At the drying course setup step S243, the dryer T may set the recommended course as the drying course before the operation of the washing machine L ends, whereby the time required for the user to select and input the drying course may not be required.

After the drying course setup step S243 is completed, the control method periodically executes a step S245 of determining whether a control signal requesting initiation of the drying course has been input through the terminal H or the dryer second input unit 923.

If initiation of the drying course is requested through the terminal H or the dryer second interface P1, the control method executes the recommended course for a preset time (S247 and S249). If the drying step S247 ends, the control method resumes the drying standby mode S210.

Unlike the case shown in in FIG. 5, if the control signal requesting initiation of the drying course set for a preset reference time is not input after the drying course setup step S243 is completed, the control method may be provided to resume the drying standby mode S210. In this case, the reference time may be set to the same time as that set for the recommended course.

The aforementioned laundry treating apparatus and the aforementioned control method for the laundry treating apparatus may be carried out by various modifications. That is, the aforementioned control method of the laundry treating apparatus may be applied to a laundry treating apparatus comprising a control system different from the control system shown in FIG. 4.

In the laundry treating apparatus provided to include the washing machine provided with the tub and the washing drum and the dryer provided with the drying drum and the supply unit for removing water from laundry by supplying the air to the drying drum, the control method for the aforementioned laundry treating apparatus may be provided to include a first communication step S142 of notifying the washing machine L or the dryer T of a washing course if the washing course is input to the washing machine interface P2 provided to receive a control command, a course selection step S230 of selecting any one of a plurality of drying courses set to the dryer by the dryer T, and a predicted time transmission step S250 of transmitting a sum of a washing time set to the washing course and a drying time set to the drying course to the terminal H provided to perform communication with at least any one of the washing machine L and the dryer T through wire or wireless communication.

The course selection step S230 may be provided to select a drying course for setting the same laundry as washing target laundry set to the washing course as a drying target or a drying course having the lowest power consumption, or a default course (drying course set to be executed when a user does not input a separate drying course selection command) set to the dryer.

The predicted time transmission step S250 may be provided to transmit any one of the washing time set to the washing course, the drying time set to the drying course, and a sum of the washing time and the drying time. If the predicted time transmission time S250 is set to transmit the sum of the washing time and the drying time, the dryer T may be provided to transmit a sum of the washing time, the drying time and additional time set to be increased in proportion to the amount of laundry to the terminal H.

If a user requests execution of the washing course input (S130) through the washing machine interface P2, the washing machine T executes the course execution step S140. The course execution step S140 may be provided to sequentially execute the laundry amount sensing stroke S141, the water supply stroke S143, the particle removal stroke S145, the drainage stroke S147, and the dehydrating stroke S149.

After the laundry amount sensing stroke S141 is completed, the washing machine L may transmit the washing course selected by the user through the first communication step S142 and the amount of laundry measured at the laundry amount sensing step to the dryer T.

Before the dehydrating stroke S149 is completed after the drainage stroke S147 is initiated, or after the dehydrating stroke S149 is completed, the dryer T may execute the drying course setup step S243 of displaying the drying course selected at the course selection step S230 on the dryer interface P1.

It will be apparent to those skilled in the art that the present disclosure may be embodied in other specific forms without departing from the spirit and essential characteristics of the disclosure. Thus, the above embodiments are to be considered in all respects as illustrative and not restrictive. The scope of the disclosure should be determined by reasonable interpretation of the appended claims and all change which comes within the equivalent scope of the disclosure are included in the scope of the disclosure.

What is claimed is:

1. A control method for a laundry treating apparatus including a washing machine and a dryer, wherein the washing machine includes a tub configured to receive water and a washing drum disposed in the tub and configured to receive laundry therein, and the dryer includes a drying drum configured to receive laundry and a supply unit configured to supply air to the drying drum to thereby remove water from the laundry in the drying drum, the control method comprising:

receiving a selection of a washing course through a washing machine interface of the washing machine;

performing the washing course by the washing machine;

providing, from the washing machine to the dryer, information related to the washing course before performing a water supply stroke for supplying water into the tub;

selecting, by the dryer without a user's selection, a drying course to be initiated at an end of the washing course among a plurality of drying courses of the dryer;

estimating a predicted washing time for completion of the washing course and a predicted drying time for completion of the drying course, wherein the predicted drying time is estimated before performing the drying course;

transmitting a sum of the predicted washing time and the predicted drying time to a terminal to thereby allow the user to determine whether to perform the drying course, the terminal being configured to, through wired or wireless communication, communicate with at least any one of the washing machine or the dryer; and performing the drying course initially after the washing course based on the drying course being selected by the user after the sum of the predicted washing time and the predicted drying time is transmitted to the terminal.

2. The control method of claim 1, further comprising:

measuring an amount of the laundry in the washing drum based on receiving the washing course through the washing machine interface, wherein providing the information related to the washing course to the dryer comprises providing information including the washing course and the amount of the laundry in the washing drum to the dryer.

3. The control method of claim 2, wherein selecting the drying course comprises:

setting a drying target based on a washing target that is set for the washing course according to the laundry in the washing drum; and selecting, among the plurality of drying courses, the drying course corresponding to the drying target.

4. The control method of claim 2, wherein selecting the drying course comprises:

selecting the drying course based the drying course having the lowest power consumption among the plurality of drying courses.

5. The control method of claim 2, wherein selecting the drying course comprises:

selecting a default course that is preset among the plurality of drying courses.

6. The control method of claim 2, wherein the predicted washing time and the predicted drying time are increased based on the amount of the laundry in the washing drum.

7. The control method of claim 2, further comprising:

determining an additional time to complete at least one of the washing course or the drying course based on the amount of the laundry in the washing drum, wherein transmitting the sum of the predicted washing time and the predicted drying time comprises transmitting a sum of the predicted washing time, the predicted drying time, and the additional time.

8. The control method of claim 1, further comprising:

measuring an amount of the laundry in the washing drum based on receiving the washing course through the washing machine interface;

after measuring the amount of the laundry in the washing drum, performing the washing course, the washing course comprising:

supplying water to the tub, based on supplying the water to the tub, rotating the washing drum to remove particles from the laundry in the washing drum, draining the water from the tub, and based on draining the water from the tub, rotating the washing drum to remove water from the laundry in the washing drum; and after starting to drain the water from the tub, displaying the drying course on a dryer interface of the dryer while rotating the washing drum to remove the water from the laundry in the washing drum.

9. The control method of claim 1, further comprising:

measuring an amount of the laundry in the washing drum based on receiving the washing course through the washing machine interface;

after measuring the amount of the laundry in the washing drum, performing the washing course, the washing course comprising:

supplying water to the tub, based on supplying the water to the tub, rotating the washing drum to remove particles from the laundry in the washing drum, draining the water from the tub, and based on draining the water from the tub, rotating the washing drum to remove water from the laundry in the washing drum by; and displaying the drying course on a dryer interface of the dryer after completion of rotating the washing drum to remove the water from the laundry in the washing drum.

10. The control method of claim 1, further comprising:

supplying power to a dryer interface of the dryer based on providing the information related to the washing course to the dryer.

11. A control method for a laundry treating apparatus including a washing machine driving unit, a washing machine first controller configured to control the washing machine driving unit, a washing machine interface, a washing machine second controller configured to control the washing machine interface, a washing machine power controller, a dryer driving unit, a dryer first controller configured to control the dryer driving unit, a dryer interface, a dryer second controller configured to control the dryer interface, a dryer power controller, the control method comprising:

based on the laundry treating apparatus being in a washing standby mode, supplying power to the washing machine second controller and the washing machine power controller while restricting supply of power to the washing machine driving unit, the washing machine interface, and the washing machine first controller;

based on the laundry treating apparatus being in a drying standby mode, supplying power to the dryer second controller and the dryer power controller while restricting supply of power to the dryer driving unit, the dryer interface, and the dryer first controller;

based on the laundry treating apparatus being released from the washing standby mode, controlling the washing machine power controller to supply power to the washing machine first controller, the washing machine driving unit, and the washing machine interface;

receiving a selection of a washing course through the washing machine interface;

performing the washing course by operating the washing machine driving unit;

providing, by the washing machine second controller to the dryer second controller, a control signal related to the washing course before performing a water supply stroke for the washing course;

selecting, by the dryer second controller without a user's section, a drying course to be initiated at an end of the washing course among a plurality of drying courses executable by the dryer driving unit;

estimating a predicted washing time for completion of the washing course and a predicted drying time for completion of the drying course, wherein the predicted drying time is estimated before performing the drying course;

transmitting a sum of the predicted washing time and the predicted drying time to a terminal to thereby allow the user to determine whether to perform the drying course, the terminal being configured to, through wired or wireless communication, communicate with at least any one the washing machine first controller, the washing machine second controller, the dryer first controller, or the dryer second controller; and performing the drying course initially after the washing course based on the drying course being selected by the user after the sum of the predicted washing time and the predicted drying time is transmitted to the terminal.

12. The control method of claim 11, further comprising:

based on receiving the washing course through the washing machine interface, measuring an amount of the laundry in a washing drum of the laundry treating apparatus by controlling the washing machine driving unit, wherein providing the control signal to the dryer second controller comprises providing information including the washing course and the amount of the laundry in the washing drum to the dryer second controller.

13. The control method of claim 12, wherein selecting the drying course comprises:

setting a drying target based on a washing target that is set for the washing course according to the laundry in the washing drum; and selecting, among the plurality of drying courses, the drying course corresponding to the drying target.

14. The control method of claim 12, wherein selecting the drying course comprises:

selecting the drying course based the drying course having the lowest power consumption among the plurality of drying courses.

15. The control method of claim 12, wherein selecting the drying course comprises:

selecting a default course that is preset among the plurality of drying courses.

16. The control method of claim 12, further comprising:

determining an additional time to complete at least one of the washing course or the drying course based on the amount of the laundry in the washing drum, wherein transmitting the sum of the predicted washing time and the predicted drying time comprises transmitting a sum of the predicted washing time, the predicted drying time, and the additional time.

17. The control method of claim 11, further comprising:

measuring an amount of the laundry in a washing drum of the laundry treating apparatus based on receiving the washing course through the washing machine interface;

after measuring the amount of the laundry in the washing drum, performing the washing course, the washing course comprising:

supplying water to a tub of the laundry treating apparatus, based on supplying water to the tub, rotating the washing drum to remove particles from the laundry in the washing drum, draining the water from the tub, and based on draining the water from the tub, rotating the washing drum to remove water from the laundry in the washing drum; and after starting to drain the water from the tub, displaying the drying course on the dryer interface of the dryer.

18. The control method of claim 17, wherein displaying the drying course on the dryer interface of the dryer comprises:

displaying the drying course on the dryer interface of the dryer while rotating the washing drum to remove the water from the laundry in the washing drum.

19. The control method of claim 17, wherein displaying the drying course on the dryer interface of the dryer comprises:

displaying the drying course on the dryer interface of the dryer after completion of rotating the washing drum to remove the water from the laundry in the washing drum.

20. The control method of claim 17, further comprising:

based on a lack of an execution request for a preset reference time after displaying the drying course on the dryer interface, stopping supply of power to the dryer driving unit, the dryer interface, and the dryer first controller while maintaining power to the dryer second controller and the dryer power controller.

21. The control method of claim 1, further comprising:

displaying the drying course on a dryer interface of the dryer after starting to drain the water from the tub of the washing machine; and performing the drying course based on receiving a drying course initiation request from the user.

22. The control method of claim 11, further comprising:

displaying the drying course on the dryer interface of the dryer after starting to drain water from a tub of the laundry treating apparatus; and performing the drying course based on receiving a drying course initiation request from the user.

* * * * *